United States Patent [19]

Bush et al.

[11] Patent Number: 4,480,460

[45] Date of Patent: Nov. 6, 1984

[54] COMPRESSION TOOL

[75] Inventors: Austin L. Bush, Birmingham; Kenneth P. Apperson, Chaulkville; Jerald C. Todd, Centerpoint, all of Ala.

[73] Assignee: Square D Company, Palatine, Ill.

[21] Appl. No.: 424,795

[22] Filed: Sep. 27, 1982

[51] Int. Cl.[3] ..... B21D 7/06

[52] U.S. Cl. ..... 72/410; 72/452; 29/751

[58] Field of Search ..... 72/410, 409, 452; 29/237, 283.5, 751; 81/180 B, 180 C, 181, 91 A, 91 R, 57.2

[56] References Cited

U.S. PATENT DOCUMENTS

| | | | |
|---|---|---|---|
| 1,086,257 | 2/1914 | Wilkinson | 81/91 A |
| 1,351,217 | 8/1920 | Richard | 81/91 A |
| 2,396,562 | 3/1946 | Forss | 72/410 |
| 2,861,490 | 11/1958 | Rozmus | 72/409 |
| 3,534,583 | 10/1970 | Demler, Sr. | 72/410 |
| 3,559,448 | 2/1971 | Illingworth et al. | 72/410 |
| 3,571,890 | 3/1971 | Brehm | 72/410 |
| 3,892,148 | 7/1975 | Wiley | 81/57.2 |

FOREIGN PATENT DOCUMENTS

| | | | |
|---|---|---|---|
| 679495 | 2/1964 | Canada | 72/410 |
| 2841588 | 3/1980 | Fed. Rep. of Germany | 72/410 |
| 418334 | 12/1910 | France | 81/186 |

*Primary Examiner*—Daniel C. Crane
*Attorney, Agent, or Firm*—Stephen A. Litchfield

[57] ABSTRACT

A compression tool head assembly for compressing a metal connector about a conductor to be connected. The assembly is adaptable to make both parallel tap connections and sleeve connections. The assembly includes a head section having two, opposing arms moveably connected thereto, each of said arms having a nib thereon; a rigid column disposed between said opposing arms and having a reversible die mounted therein, said die having a nib at one end and a "C" shaped section at its other end; a hydraulic pump section is connected to the head section and operates to move the head section towards the rigid column; the arms have cammed surfaces which interact with rollers fixed to the rigid column to cause the arms to move towards each other as the head is moved towards the rigid column; as the arms move towards each other the nibs will compress an article disposed therebetween; the arms having a connecting pin arrangement at their outer ends such that they may be pivoted and joined together; the nibs on the arms are formed such that when the arms are joined together an upper "C" section is formed; by reversing the die in the rigid column the "C" section in the die forms a lower "C" section against which the upper "C" section will move to compress a connector.

15 Claims, 9 Drawing Figures

COMPRESSION TOOL

BACKGROUND OF INVENTION

1. Field of the Invention

This invention pertains to compression tools and more particularly to hand operated compression tools adapted for exerting a large compression force.

2. Description of the Prior Art

A number of hydraulic compression tools have been developed for compressing metal connectors about electrical conductors to form an electrical and structural connection between two conductors, or between a conductor and a terminal. When two conductors are connected, each conductor end is inserted into an open end of a connector. The connector is then exteriorly compressed by the hydraulic compression tool to mechanically lock the conductors to the connector and to establish electrical continuity between them.

There are currently many types of connectors in use. One type commonly used is of a cylindrical configuration, called a sleeve connector, which will connect two conductors together in a straight line. A variation of this type provides a cylindrical section with a flat portion for connection of a conductor to a terminal. Another type of connector in common use is of an "H" type design, called a parallel tap connector, which has two, parallel open sections. A conductor is inserted in each open section and then, by compression, the open ends of the connector are closed and locked over the conductors by the compression tool. The McDurmont U.S. Pat. No. 3,154,981 and the Campbell, et al U.S. Pat. No. 4,350,843, illustrate a prior art hydraulic compression tools. Further examples of prior art hydraulically operated tool heads are disclosed in U.S. Pat. Nos. 2,821,877, 3,230,713, 4,136,549, 2,688,231, 2,254,613, 3,417,599, and 2,696,850.

Some compression tools which compress cylindrical connectors utilize a plurality of opposed, pointed, nibs which are urged towards a common center as the levers of the tool are operated. Each of these nibs compress a portion of the connector onto the conductor ends. Other compression tools use opposing "C" shaped dies which are urged towards one another to compress the connector to the conductor. These types of tools may be used on both cylindrical and "H" type connectors. For "H" type connectors the curvature of the dies act to fold the open positions of the connector over the conductor thereby closing the connector over the conductor and locking the connector to the conductor.

Generally, tools designed to accept the "C" shaped dies for the "H" type connectors will compress only a limited range of cylindrical connectors. Also, tools having the opposing, pointed nibs will not fold the open portion of an "H" type connector over the conductor to satisfactorily lock the connector to the conductor. Thus, one disadvantage of the prior art was that the use of cylindrical connectors generally required the use of a particular type of compression tool to achieve the appropriate connection. The use of an "H" type connector required the use of another type of tool. If both cylindrical and "H" connectors were required on a job, two separate types of compression tools had to be used.

There are also many different conductor diameters in use. Generally, the diameter or size of a connector will correspond to the conductor diameter to which it is to be joined. In the past, some compression tools required the use of interchangeable dies of varying sizes to accommodate different sizes of connectors. Other tools could only crimp specific sizes of connectors and different tools would have to be used for varying sizes of connectors.

One disadvantage in using a tool that requires varying sizes of dies is that many times a particular die size is lost or not available for the connector size to be compressed in the field. This renders the tool useless for that particular compression connection. Another disadvantage in changing dies for each change in connector size or in changing tools for changes in connector size is that such changes are time consuming and increase the job time where multiple connections are being made on varying sizes of conductors. Thus, traditional compression tools required that a separate inventory of tools and dies be kept on hand in the field. Each time a connector size is changed the lineman must determine which tool or which die size is proper for the intended connection.

In view of the above disadvantages, there is a need in the field for a tool which will accommodate both cylindrical connectors and "H" type connectors. Further, there is a need in the field for a compression tool which uses a minimum number of dies to compress a maximum variety of connector sizes. Also, there is a need for a compression tool which is easily and quickly convertible from use on cylindrical connectors to use on "H" type connectors and vice versa, where such conversion can be made in the field and without substantial modification to the tool.

SUMMARY OF THE INVENTION

A principal object of the present invention is to provide a handheld compression tool which will compress both cylindrical connectors and "H" type connectors with relatively minor modifications to the tool. Another object of the invention is to provide a handheld compression tool which will convert from use on one type of connector to another in the field without the use of tools or extraneous components. These objects are accomplished by providing a hydraulically operated, compression tool having a head section, a pair of opposing arms moveably connected thereto, a cylinder rotatably connected to said head section and a hydraulic section having operating levers, a valve body, and a rigid die holding column connected to said valve body. The operating levers actuate the hydraulic section and cause the cylinder and head section to move towards the rigid column. The rigid column has a yoke that is stationary and has rollers mounted thereon. The opposing arms moveably pinned to the head section have cam like surfaces at their ends which move against the rollers of the yoke when the levers are operated. As the head section moves toward the rigid column and the yoke, the opposing arms are forced together by virtue of the action of the rollers on the cammed surfaces of the arms. On the inner surfaces near the ends of each of the arms, are edged, opposing nibs which move symetrically towards a third, edged nib which is formed on a die removeably located in the rigid column. The three nibs cooperate to compress a cylindrical connector as the levers are operated and the head section moves towards the die.

To convert the tool to compress an "H" type connector, the die contained in the rigid column is removed and reversed. At the opposite end of the die is a "C" shaped section which, when secured in the rigid column is exposed to the arms of the tool head. The arms are rotated toward each other and connected together at their outer ends by a pin. When so connected the nibs on the arms meet to form a second, upper "C" shaped section, opposing the "C" shaped section of the die held in the rigid column of the tool. Connected in this manner, the tool is now able to compress an "H" type connector with no further modification to the tool. As the levers are operated the cylinder moves back and urges the upper "C" section towards the lower "C" section. The lower "C" section is fixed in position and will provide a nest against which the upper "C" section will exert its compressive force. In this manner the tool is able to accommodate cylindrical and "H" type connectors with relatively minor modifications to the tool.

Another object of the invention is to provide a tool head assembly in which the conversion from one type of connector to another is made quickly, easily and without tools or extraneous components. This object is accomplished by positioning a pin on one of the arms of the tool head such that it will communicate through a corresponding aperture in each of the arms, when the arms are rotated together. The pin will hold the arms in place when the respective apertures are aligned. The pin is moveably attached to one of the arms and is spring biased in an open position. The spring tension in the pin is designed to be less than the frictional force exerted on the pin when the spring loaded arms are mated and the pin inserted. Thus, when not in use the spring maintains the pin in an out of the way position. When inserted the spring force cannot ovecome the frictional force on the pin by the spring loaded arms and thus, the arms will remain in a closed position. By simply compressing the arms towards each other, the frictional force on the pin is removed and the spring loading of the pin will cause the pin to move back out of the apertures to the open position thereby unlocking the arms of the tool head in one simple step and without the use of tools or other components.

Another object of the present invention is to provide a compression tool which will accommodate a number of different cylindrical connector sizes without changing the die for each connector size. The above object is accomplished by designing the cam surfaces of the arms so that the nibs on the arms are always urged towards a common center when the tool is operated for use with a cylindrical connector. Thus, the nibs will move towards the common center without regard to the size of the connector being compressed. By spring biasing the arms in an open position so that they will accept a variety of different sized connectors, the nibs will be able to compress a wide variety of cylindrical connector sizes.

Further, when the tool is used to compress large cylindrical connectors or "H" type connectors the upper "C" section is designed to exert a compressive force on a connector from its retracted position to the nest formed by the lower "C" section of the yoke. In this manner, a variety of "H" connector sizes can be compressed by the tool without a die change.

To further insure that a consistent crimp is received a release valve mechanism is provided in the tool. This release valve furthers the tool's ability to accommodate a varying number of connector sizes as the tool will continue to compress the connector without regard to its size until the desired compression is achieved.

BRIEF DESCRIPTION OF SEVERAL VIEWS OF DRAWINGS

The features of the present invention which are believed to be novel are set forth with particularity in the appended claims. The invention together with further objects and advantages thereof, may best be understood by reference to the following description taken in conjunction with the accompanying drawings, in the several figures of which like reference numerals identify like elements, and in which:

DETAILED DESCRIPTION

Figure 1:
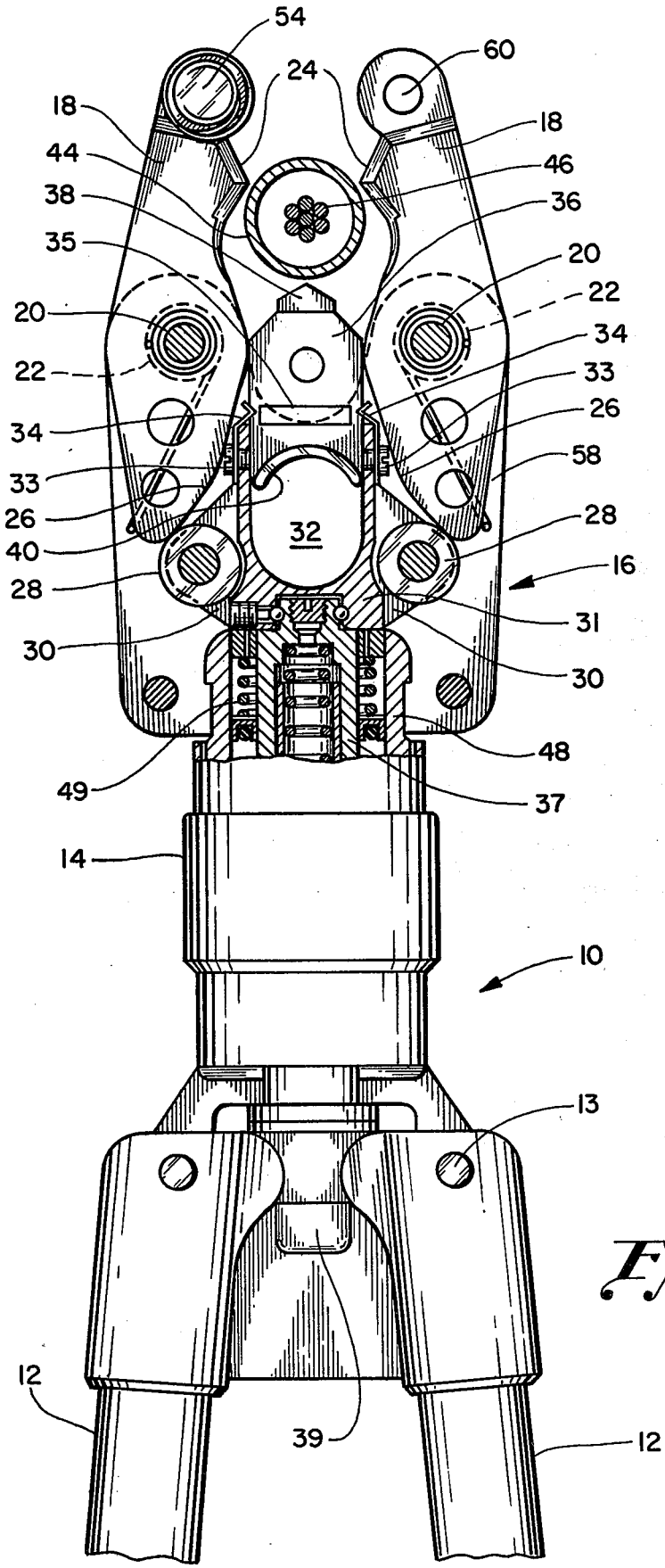
FIG. 1 is a front view of the tool head partly broken away to reveal the pivotable arms having compression nibs thereon and cammed surfaces adjacent the yoke rollers with a reversible die mounted thereon.

Referring first to FIG. 1 of the drawings, hydraulic hand tool 10 is shown in operating position to crimp a cylindrical connector 44 about a conductor 46. Hand tool 10 has operating levers 12 connected to hydraulic section 14 which is in turn joined with head section 16. Head section 16 has arm support members 58 connected thereto. Arms 18 are joined to support members 58 by pins 20. Arms 18 are spring biased by virtue of springs 22 in an open position. Arms 18 have opposing, edged nibs 24. Head section 16 is rotably secured to cylinder 48. Cylinder 48 is disposed around rigid column 31 and is connected to and moveable by hydraulic section 14. When levers 12 are operated cylinder 48 is moved with respect to rigid column 31 back towards the levers 12 and thus draws head section 16 towards the levers 12.

Arms 18 have cammed surfaces 26, against which rest rollers 28. Rollers 28 are pivotally connected to yoke 30. Yoke 30 is formed on rigid die holding column 31. Rigid column 31 is connected to a valve body 37 which forms part of a hydraulic section 14. The hydraulic section 14 is not shown in detail as it is intended that the disclosed, novel head section may be used with any conventional hydraulic system to move the cylinder 48 with respect to the rigid column 31.

Spring 49 shown in FIG. 1 is disposed between cylinder 48 and valve body 37 and is compressed as cylinder 48 is advanced over rigid column 31 and valve body 37. Cylinder 48 is drawn over valve body 37 by the hydraulic action of hydraulic section 14. Hydraulic section 14 is operated by the movement of arms 12 about pivot points 13. The movement of arms 12 causes pump plunger 39 to move with respect to hydraulic section 14 and creates hydraulic pressure in the hydraulic section 14. Rigid column 31 has recessed section 32 therein which contains removeable die 36. Screws 33 hold leaf spring clamp 34 to rigid column 31. Leaf spring clamp 34 is mounted on the outer surface of column 31 to hold die 36 in place. Die 36 is placed in recessed section 32 and secured by the leaf springs 34. Bar 35 rests against the upper surface of column 31 and prevents die 36 from moving into recessed section 32 as a connector is compressed. Die 36 has at one end, edged nib 38 and at its opposite end "C" shaped section 40. Grooves 42 on reversible die 36 (shown more clearly in FIG. 5) mate with leaf spring clamp 34 on recessed section 32 of column 31 to hold reversible die 36 in place.

It can be readily seen in FIG. 1 that nibs 24 and 38 form three compression points upon which cylindrical connector 44 will be compressed about conductor 46. Further, due to the design of cammed surfaces 26 and rollers 28, as cylinder 48 is moved back by levers 12 and hydraulic section 14, nibs 24 close towards a common center point over nib 38 thereby compressing connector 44 about conductor 46. It is seen that with the backward movement of head section 16, as levers 12 are operated, the tool will shorten somewhat in length as the crimp is achieved. This shortening is minimal and will not affect the use of the tool.

Since the arms 18 of head section 16 are spring biased in an open position and since the tool head 16 is open at the top, great advantage is realized as the tool 10 is able to be used on existing power and electric lines without disconnecting the line. Further, a multitude of different sized cylindrical connectors can be used in association with the above assembly without any changes of die 36 whatsoever. So long as the cylindrical connector will fit within arms 18 in their open position the connector can be compressed. Also, head section 16 can rotate with respect to the rest of tool 10 about cylinder 48. This feature allows the tool more flexibility in use in the field.

Figure 3:
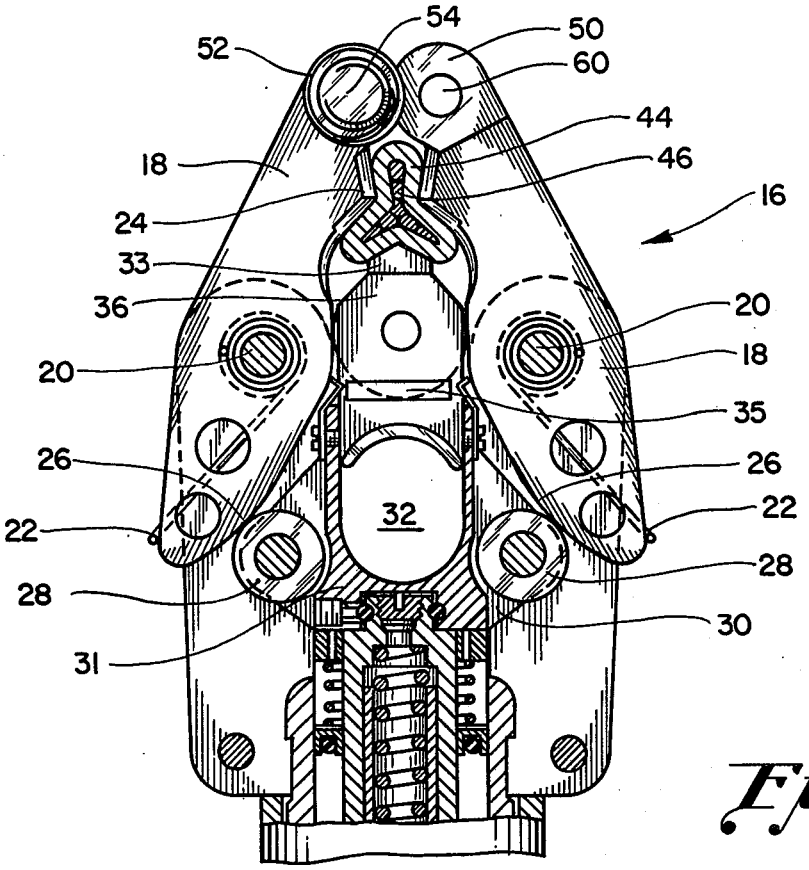
FIG. 3 illustrates in front view the tool head in compression of a cylindrical connector, showing the three opposing nibbed, edges converging on a common center.

While FIG. 1 shows head section 16 in a position ready to begin a compression of a cylindrical connector, FIG. 3 shows tool head 16 with column 31 in an advanced position. In this position it has fully compressed connector 44 and conductor 46. It can be seen in FIG. 3 that arms 18 have rotated about pins 20 and that nibs 24 have converged towards a common center point over nib 38, causing the compression of cylindrical connector 44. It is seen in FIG. 3 that even though arms 18 have pivoted towards each other the cammed surfaces 26 are designed such that they do not interfere with reversible die 36 as head section 16 is moved towards column 31. Once a predetermined compressive force has been reached, hydraulic section 14 of the tool (not shown in detail) operates to release the pressure. The pressure at which the tool is designed to operate is in the range of 9350 to 10,000 pounds per square inch. The release valve is preset to release the tool pressure of about 9800 pounds per square inch, plus or minus 150 pounds per square inch variance. Thus, uniform and consistent crimps are achieved by the tool.

It should also be noticed in FIG. 3 that arms 18 have a male and female section. Male section 50 mates with female section 52 in such a manner that the movement of arms 18 is not restricted as nibs 24 converge to their common center point. When the tool pressure is released, the springs 22 which bias arms 18 in an open position will cause cam surfaces 26 to remain adjacent rollers 28 as head section 16 is retracted.

Figure 2:
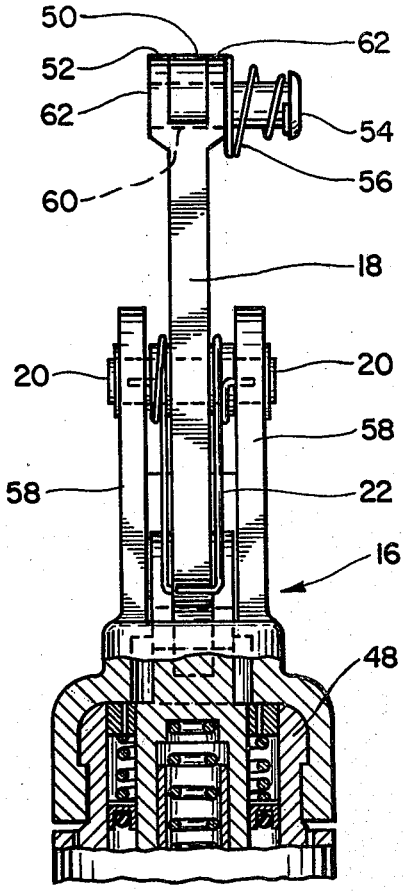
FIG. 2 shows a side view of the tool head with a portion of the hydraulic section of the tool partly broken away.

Referring now to FIG. 2, tool head 16 is shown in side view with male section 50 mated with female section 52. Also shown in FIG. 2 is restraining pin 54. Restraining pin 54 is spring biased by virtue of spring 56 in an open position. Restraining pin 54 is moveably connected to female section 52 of one of the arms 18. Male section 50 of arm 18 has aperture 60 therein, having a diameter such that it will allow access of pin 54. Female section 52 has aperture 62 therein which receives pin 54. Arm support members 58 of tool head 16 pivotally hold arms 18 in place by virtue of pins 20. Arm support members 58 provide the structural support for arms 18 and provide a base against which spring 22 can flex to keep arms 18 biased in an open position.

Figure 4:
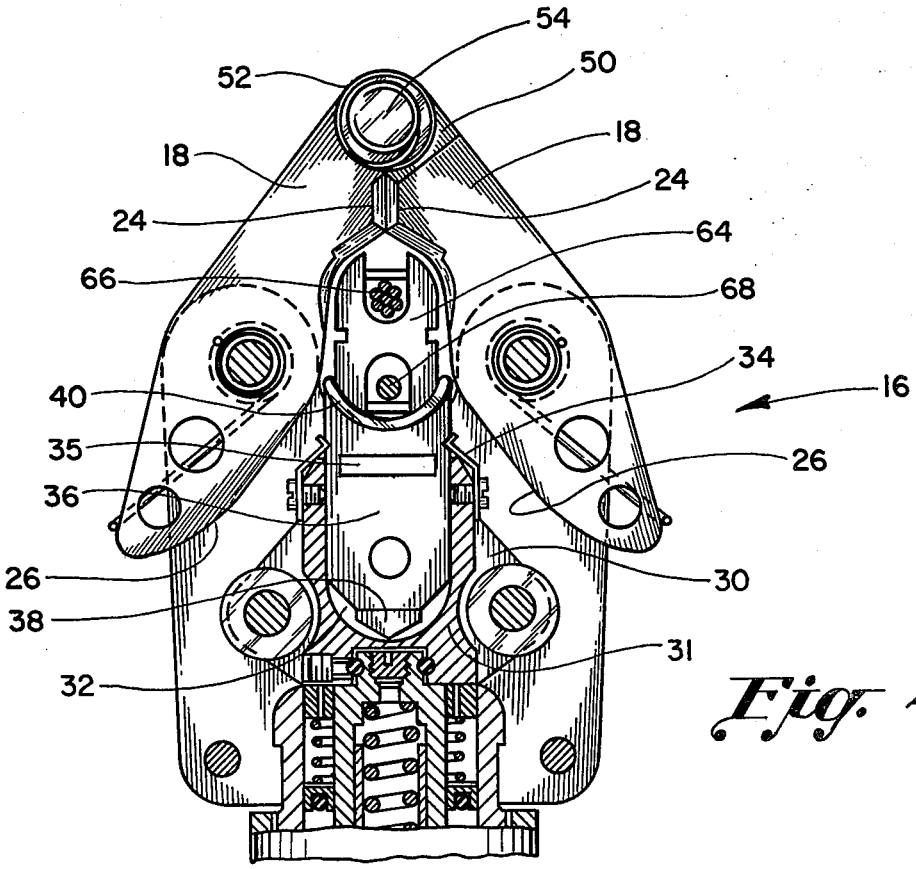
FIG. 4, shows the tool head in a reversed capacity for compressing large cylindrical or "H" type connectors.

FIG. 3 illustrates arms 18 as they begin to close upon cylindrical connector 44. They show male section 50 beginning to mate with female section 52. FIG. 4 illustrates the completed mating of male section 50 and female section 52 of arms 18. FIG. 4 also illustrates the tool 10 positioned for compression of a large cylindrical connector or the "H" type connector 64 as shown. Note that nibs 24 are preformed and designed such that they each form one-half of a "C" shaped section. When arms 18 are closed together and male section 50 and female section 52 are mated with pin 56 inserted through apertures 60 and 62, the upper portion of head section 16 forms an upper "C" section. Note that when arms 18 are locked together by virtue of pin 54, head section 16 is in its fully extended position.

When arms 18 are mated, pin 54 is pushed through apertures 60 and 62 to connect and restrain the arms 18 in their closed position. Pin 54 is held in place by exerting a frictional force on it through arms 18. The springs 22 of arms 18 which bias the arms 18 in an open position create an outward force exerted on pin 54 when the arms 18 are closed and secured by pin 54. This outward force is designed to create a frictional resistance of the apertures 60 and 62 on pin 54 which is greater than the spring force on pin 54 created by the compression of spring 56 when pin 54 is inserted into apertures 60 and 62. Thus, once secured together in this manner, arms 18 will not open and the upper "C" shaped section formed by nibs 24 will remain constant for the extent of the crimping process.

When the arms are to be opened, they are compressed towards each other by the tool operator, thereby relieving the frictional resistance of the apertures 60 and 62 on pin 54 and allowing spring 56 to pull pin 54 through apertures 60 and 62, thereby releasing arms 18 and allowing springs 22 to bias arms 18 in the open position. Thus, in one relatively simple motion the tool arms are returned to their open position.

FIG. 4 illustrates die 36 reversed such that the "C" shaped section 40 is opposing the "C" shaped section formed by nibs 24. Again, flat bar 35 rests against the upper end of the rigid column 31 and prevents die 36 from moving further into recessed section 32. Recessed section 32 of column 31 is designed such that it will accommodate die 36 as reversed including the edged nib 38. Grooves 42 interact with leaf springs 34 to hold die 36 in place in recessed section 32 of column 31. An "H" type connector 64 is shown disposed between the upper "C" shaped section formed of nibs 24 and lower "C" shaped section 40. Conductor 66 is shown placed in one of the open areas of "H" type connector 64. Conductor 68 is shown placed in another open section of "H" type connector 64. As head section 16 is moved back by the operation of levers 12, the upper "C" shaped section formed by nibs 24 is moved towards the lower "C" shaped section 40. This lower "C" shaped section acts as a nest against which the upper "C" shaped section will compress connector 64. Note again that the design of the cammed surfaces of arms 18 is such that the advance of arms 18 in their closed position will not interfere with either of the rollers 28 of yoke 30.

Figure 5:
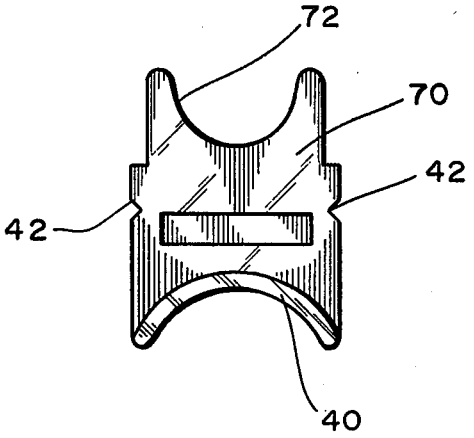
FIG. 5, shows in front view a reversible die having on each end a "C" shaped section of different sizes for compression of differently sized "H" type connectors.
Figure 6:
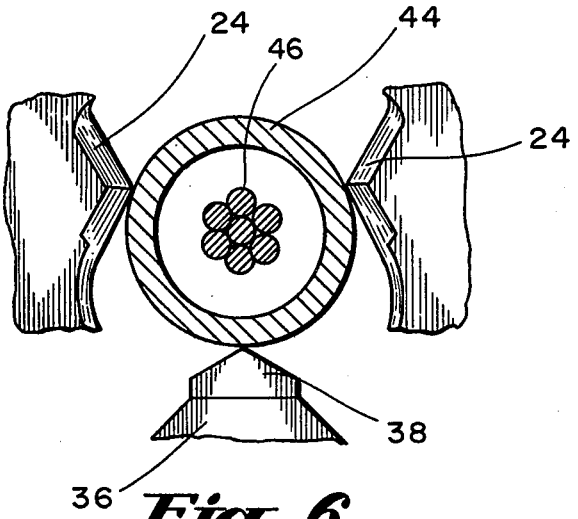
FIGS. 6, 7, 8 and 9 illustrate in successive views the compression of a cylindrical connector to a cable.
Figure 7:
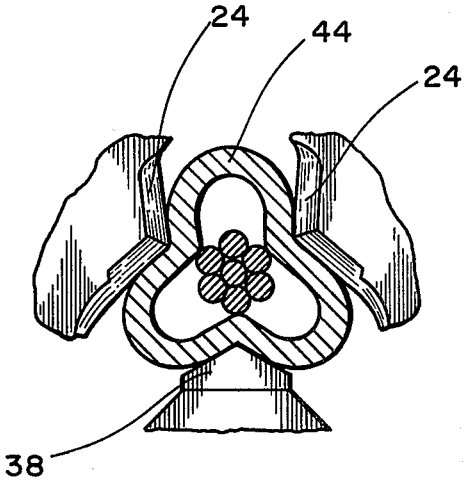
Figure 8:
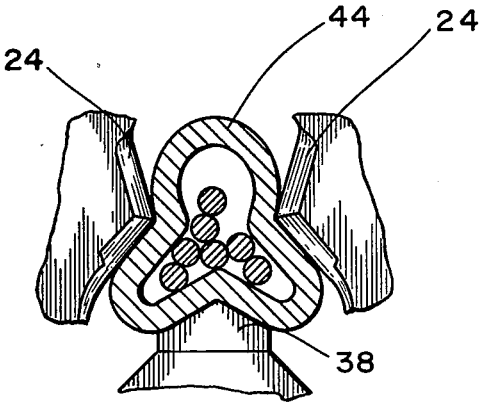
Figure 9:
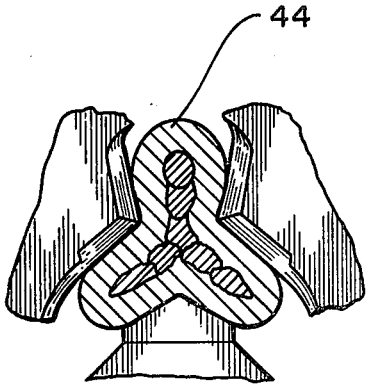

FIG. 5 illustrates a modified reversible die 70 which has "C" shaped section 40 at one end and an opposing "C" shaped section 72 at rhe opposite end. Die 70 also has grooves 42 which will mate with leaf spring clamp 34. Reversible die 70 is an alternate die to compress different sized connectors. "C" shaped section 72 has a noticeably smaller diameter than "C" shaped section 40. Section 72 will cause more efficient crimping of a smaller connector than the larger diameter "C" shaped section 40. Die 70 is quickly insertible into recessed section 32 of rigid column 31 such that either end may be exposed for use in the tool head.

FIGS. 6, 7, 8 and 9 illustrate in sequence the crimping action of the three way crimp of nibs 24 and nib 38. It should be noted that the substantial deformation of connector 44 causes deformation at the point of crimping of cable 46 such that a secure connection is made between the connector and the cable. This three way connection provides a secure structural and electrical connection between the cable and connector and will allow a significant tensile stress to be placed on the cable without separating it from the conductor.

This invention is not limited to the particular details of the apparatus depicted and other modifications and amplifications are contemplated. Certain other changes may be made in the above described apparatus without departing from the true spirit and scope of the invention herein described. It is intended, therefore, that the subject matter in the above depiction shall be interpreted as illustrative and not in a limiting sense.

We claim:

1. A hydraulically operated crimping tool head assembly having a pair of operating levers, a hydraulic section and a head section operated by the hydraulic section, for use in compressing a connector to a conductor, the improvement comprising:

a head section having rotably mounted thereto a pair of elongate, opposing arms, said arms defining a connector receiving area, each arm having means for locking said arms together at their outermost ends and each arm having a cammed surface thereon, each said arm having a crimping nib disposed between said outermost end and said cammed surface, each said crimping nib projecting into said connector receiving area so that said nib acts to indent the connector during crimping by rotation of said arms, said crimping nibs forming an upper, generally C-shaped section in said connector receiving area when the outermost ends of the arms are locked together, a column disposed between the arms, said column having a die receiving portion therein and a pair of rollers rotably mounted thereto, each said roller adjacent a cammed surface of said arms, and a die removably mounted in said die receiving portion of said column, such that when the arms are locked together at their outermost ends the tool is prepared for crimping an "H"-type connector, and when said arms are unlocked the tool is prepared for crimping a cylindrical type connector.

2. The apparatus of claim 1 where the removable die mounted in the die receiving portion of the column has a crimping nib thereon, said nib projecting into the connector receiving area, such that when said arms are in the open position the tool head is prepared for crimping a cylindrical connector.

3. The apparatus of claim 1 where the removable die mounted in the die receiving portion of the column has a generally "C"-shaped section, said "C"-shaped section projecting into the connector receiving area such that when the arms of the tool head are locked together at their outermost ends, the tool is prepared to crimp an "H"-type connector.

4. The apparatus of claim 1 where the removable die has at one end a crimping nib and at another end a generally "C"-shaped section, said die reversibly mountable in the die receiving portion of the column such that either the generally "C"-shaped section of the die or the crimping nib of the die may be exposed to the connector receiving area of the tool head.

5. The hydraulic crimping assembly of claim 1 where said arms have connected thereto, means for biasing said arms against said rollers.

6. The hydraulic crimping assembly of claim 5 where said biasing means comprise springs placed adjacent each arm and connected thereto such that said springs create an outward force on said arms, to maintain the cammed surfaces of the arms adjacent the rollers when the tool head is prepared to crimp a cylindrical connector.

7. The hydraulic crimping assembly of claim 1 where the head section is rotably joined to a cylindrical section, said cylindrical section forming a part of the hydraulic section whereby the head assembly and the column may rotate about the cylindrical section.

8.The hydraulic crimping assembly of claim 1 where the cammed surfaces of said arms react with the rollers to maintain an equidistant relationship between the crimping nibs located thereon and the crimping nib on the removable die when the tool head is prepared for crimping a cylindrical connector.

9. The hydraulic crimping assembly of claim 1 where the arm locking means comprises:

a spring connected to each said arm and said head section, the springs biasing the arms in an open position;

a male projecting section at the outermost end of one of said arms, a female receiving section at the outermost end of the other of said arms, said male section receivable in said female section when said arms are closed together;

apertures in said male and female sections, said apertures being aligned when said arms are closed together;

a spring and pin movably secured to one of said arms and disposed over one of said apertures, said pin being spring biased in a direction away from said apertures, said pin insertable through said apertures when said apertures are aligned, such that when the pin is inserted through the apertures the force of said spring biasing of the pin is less than a frictional force exerted on the pin by the outward spring biasing of said arms such that the arms remain in their locked position until the frictional force on the pin is overcome.

10. A tool head for use in compressing a connector to a conductor, where said tool head is able to accommodate a variety of connector types and sizes and may be utilized with a drive means, said tool head comprising:

a pair of opposing arms rotably connected to a head section each of said arms having a locking means at one end and a cammed surface at another end thereon, said arms defining a connector receiving portion and having crimping nibs disposed between said ends for compressing a connector, each crimping nib projecting into the connector receiving area so that said nib acts to indent the connector during crimping by rotation of said arms, said nibs forming a generally "C"-shaped section when said arms are locked together at said one end, a cylinder connected to said head section at one end and disposed around a rigid column, said rigid column having formed thereon a pair of rollers, each said roller in alignment with a cammed surface of said arms, said rigid section having formed thereon a die receiving portion, means for biasing said cammed surfaces of said arms against said rollers, a die removably secured to said die receiving portion of said rigid column, said die having at one end a crimping nib and said die having at another end a generally "C"-shaped section, said die being reversible in said die receiving portion of the rigid column such that when said arms are locked and said die has the end with the generally "C"-shaped section exposed to the connector receiving area, said tool head is prepared to crimp an "H"-type connector, and when the arms are unlocked and said die has the end with the crimping nib exposed to the connector receiving area, the tool is prepared to crimp a cylindrical connector.

11. A compression tool for compressing a connector about a conductor having a hydraulic section operated by a pair of operating levers or other means, a head section having movably secured thereto a pair of elongated arms, each arm having a pointed nib thereon and each arm defining a portion of a connector receiving area, and a nest defined by a die against which the nibs act to compress a connector, the improvement comprising:

each pointed nib projecting into the connector receiving area so that said nib acts to indent a cylindrical type connector during crimping by movement of said arms and a generally "C"-shaped section formed by said nibs when the arms are compressed together, and means for locking said arms together to maintain the generally "C"-shaped section, such that said nibs when locked together provide a compression portion in the connector receiving area such that an "H"-type connector can be compressed against the nest.

12. The apparatus of claim 11 where the locking means comprises an outer section of one arm having means for receiving the outer section of the other arm when said arms are compressed together, an aperture in each of said outer sections, each aperture spaced in each said outer section such that said apertures are aligned when said arms are compressed together, a pin removably inserted through said apertures to maintain said arms in the closed position.

13. The apparatus of claim 12 where each said arms and said head section have a spring connected thereto, said spring biasing the arms in an open position, thereby creating a force on said pin and causing said pin to remain in said apertures.

14. The apparatus of claim 13 where the pin has connected thereto a spring, said spring also connected to one of said arms and positioned over one of said apertures such that said spring maintains the pin in a constant relationship to the aperture.

15. The apparatus of claim 14 where the spring force on the pin is less than the spring force on the arms on said pin when said pin is inserted through said aperture, such that the spring force of the arms on the pin causes the pin to remain in the apertures until the spring force is overcome and the spring biasing of the pin causes it to move out of the apertures and return the arms to the open position.

* * * * *